US012528632B2

(12) United States Patent
De Niro Pipher et al.

(10) Patent No.: US 12,528,632 B2
(45) Date of Patent: Jan. 20, 2026

(54) WINE STORAGE CONTAINER

(71) Applicant: JULIET WINE INCORPORATED, New York, NY (US)

(72) Inventors: Lauren De Niro Pipher, New York, NY (US); Allison Luvera, New York, NY (US)

(73) Assignee: JULIET WINE INCORPORATED, New York, NY (US)

( * ) Notice: Subject to any disclaimer, the term of this patent is extended or adjusted under 35 U.S.C. 154(b) by 326 days.

(21) Appl. No.: 18/120,090

(22) Filed: Mar. 10, 2023

(65) Prior Publication Data

US 2024/0300721 A1 Sep. 12, 2024

(51) Int. Cl.

| | |
|---|---|
| ***B65B 5/04*** | (2006.01) |
| ***B65D 5/46*** | (2006.01) |
| ***B65D 5/72*** | (2006.01) |
| ***B65D 25/28*** | (2006.01) |
| ***B65D 77/06*** | (2006.01) |
| ***B65D 77/30*** | (2006.01) |

(52) U.S. Cl.

CPC ..... *B65D 77/06* (2013.01); *B65B 5/04* (2013.01); *B65D 5/46* (2013.01); *B65D 5/725* (2013.01); *B65D 25/287* (2013.01); *B65D 77/062* (2013.01); *B65D 77/30* (2013.01)

(58) Field of Classification Search

CPC ..... B65D 77/06; B65D 25/287; B65D 77/30; B65D 5/725; B65D 5/46; B65D 77/062; B65B 5/04

See application file for complete search history.

(56) References Cited

U.S. PATENT DOCUMENTS

| | | | | | |
|---|---|---|---|---|---|
| 2,487,491 | A | * | 11/1949 | Stone | B65D 25/287 206/427 |
| 4,421,253 | A | * | 12/1983 | Croley | B65D 77/061 222/173 |
| 4,516,693 | A | * | 5/1985 | Gaston | B65D 77/06 222/105 |
| 5,067,636 | A | * | 11/1991 | Pfeiffer | B65D 77/06 222/105 |
| 5,143,278 | A | * | 9/1992 | Petriekis | B65D 5/323 229/940 |
| 5,419,485 | A | | 5/1995 | Petriekis et al. | |
| 6,554,164 | B1 | | 4/2003 | Jones | |

(Continued)

OTHER PUBLICATIONS

GB IPO Search Report, corresponding Application No. GB2319833.6, issued May 9, 2025, 2 pps.

(Continued)

*Primary Examiner* — Frederick C Nicolas

(74) *Attorney, Agent, or Firm* — Womble Bond Dickinson (US LLP)

(57) ABSTRACT

A wine container including: a lid; a lower portion including a first end and a second end opposite to the first end, wherein the first end includes an opening and the second end includes a base; a handle; and a perforated region, wherein the lid is configured to be attached to the lower portion at the first end of the lower portion, wherein the handle is attached to the lower portion, wherein the perforated region is located on a bottom third of the lower portion; and wherein the perforated region is configured to be removable to form a perforated opening.

16 Claims, 6 Drawing Sheets

(56) References Cited

U.S. PATENT DOCUMENTS 7,958,995 B2 * 6/2011 Dedmon ..... B65D 77/061 206/386
8,459,503 B2 * 6/2013 Groesbeck ..... B65D 5/4608 222/105
10,479,565 B2 * 11/2019 Deutsch ..... B65D 45/02
10,961,036 B2 3/2021 Belgya
2009/0078721 A1 * 3/2009 Hoffman ..... B65D 77/06 222/105
2009/0159594 A1 * 6/2009 Nielsen ..... B67D 3/045 222/105
2009/0255927 A1 * 10/2009 Flecknoe-Brown ..... C12H 1/22 426/11
2010/0147884 A1 * 6/2010 Compton ..... B67D 7/0277 222/105
2011/0111938 A1 * 5/2011 Smith ..... B31B 50/26 493/162
2011/0266287 A1 11/2011 Groesbeck
2012/0024896 A1 2/2012 Scobey et al.
2012/0255971 A1 * 10/2012 Griffith ..... A47G 23/0258 222/105
2013/0087470 A1 * 4/2013 Cheng ..... A45C 13/02 206/162
2013/0327818 A1 * 12/2013 Schultz ..... B65D 5/029 229/117
2015/0001251 A1 * 1/2015 Smith ..... B65D 5/16 493/93
2015/0353256 A1 * 12/2015 Smith ..... B65D 5/46096 493/162
2017/0174409 A1 * 6/2017 Sagona ..... C23C 16/045
2020/0180834 A1 * 6/2020 McRae ..... B65D 5/566
2021/0039828 A1 2/2021 Song et al.

OTHER PUBLICATIONS

GB IPO Search Report, corresponding Application No. GB 2319833.6, issued May 12, 2025, 8 pps.

* cited by examiner

WINE STORAGE CONTAINER

BACKGROUND

1. Field

Embodiments of the present disclosure relate generally to a wine storage container.

2. Description of the Related Art

Wine may be transported and sold using a variety of types of containers. Some of the containers may include a glass wine bottle, a plastic bag, or a cardboard box. However, many wine containers may have bulky shapes, such as rectangular cardboard boxes, that may be difficult to compactly store in common storage locations, such as a wine refrigerator. Additionally, the packaging of wine containers are generally discarded after a single use, which can lead to substantial environmental waste. A new container design that allows for reusable, compact storage of wine that limits environmental waste may be needed.

SUMMARY

Aspects of embodiments of the present disclosure are directed toward a wine storage container.

Additional aspects will be set forth in part in the description which follows and, in part, will be apparent from the description, or may be learned by practice of the presented embodiments of the disclosure.

Some example embodiments of the present disclosure may include a wine container including: a lid; a lower portion including a first end and a second end opposite to the first end, wherein the first end includes an opening and the second end includes a base; a handle; and a perforated region, wherein the lid is configured to be attached to the lower portion at the first end of the lower portion, wherein the handle is attached to the lower portion, wherein the perforated region is located on a bottom third of the lower portion; and wherein the perforated region is configured to be removable to form a perforated opening.

According to some example embodiments, the lower portion is a cylindrical tube.

According to some example embodiments, the perforated region includes a perforated circle and a perforated trapezoid, wherein the perforated circle is positioned adjacent to a base of the perforated trapezoid.

According to some example embodiments, the perforated circle has a diameter of about 1.5 inches and the perforated trapezoid has a height of about 2 inches.

According to some example embodiments, the handle is attached to the lower portion proximate to the first end of the lower portion.

According to some example embodiments, the base includes two paper disks bound together with an adhesive.

According to some example embodiments, the wine container further includes an inner wine container inside the wine container.

According to some example embodiments, the inner wine container includes wine and a wine tap for dispensing the wine inside the inner wine container.

According to some example embodiments, the wine container includes kraft paperboard.

Some example embodiments of the present disclosure may include a method for inserting an inner wine container into a wine container, wherein the inner wine container includes wine and a wine tap for dispensing the wine, and wherein the wine container includes a lid at a first end of the wine container, a lower portion, and a perforated region on the lower portion, the method includes: removing the lid from the first end of the lower portion to expose an opening at the first end of the lower portion; removing the perforated region to form a perforated opening; inserting the inner wine container into the opening of the lower portion; inserting the wine tap of the inner wine container through the perforated opening such that the wine tap protrudes from a surface of the wine container; and reattaching the lid to the first end of the lower portion.

According to some example embodiments, the lower portion is a cylindrical tube.

According to some example embodiments, the perforated region includes a perforated circle and a perforated trapezoid, wherein the perforated circle is positioned adjacent to a base of the perforated trapezoid.

According to some example embodiments, the perforated circle has a diameter of about 1.5 inches and the perforated trapezoid has a height of about 2 inches.

According to some example embodiments, the lower portion further includes a base at a second end opposite to the first end of the lower portion.

According to some example embodiments, the base includes two paper disks bound together with an adhesive.

According to some example embodiments, the wine container includes kraft paperboard.

Some example embodiments of the present disclosure may include a wine container including: a hollow tube including a first end and a base; and a perforated region positioned on a lower portion of the base of the hollow tube, wherein the perforated region includes a perforated circle and a perforated trapezoid, wherein the perforated circle is positioned adjacent to a base of the perforated trapezoid, and wherein the perforated region is configured to be removable to form a perforated opening.

According to some example embodiments, the perforated circle has a diameter of about 1.5 inches and the perforated trapezoid has a height of about 2 inches.

According to some example embodiments, the base includes two paper disks bound together with an adhesive.

According to some example embodiments, the wine container includes kraft paperboard.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
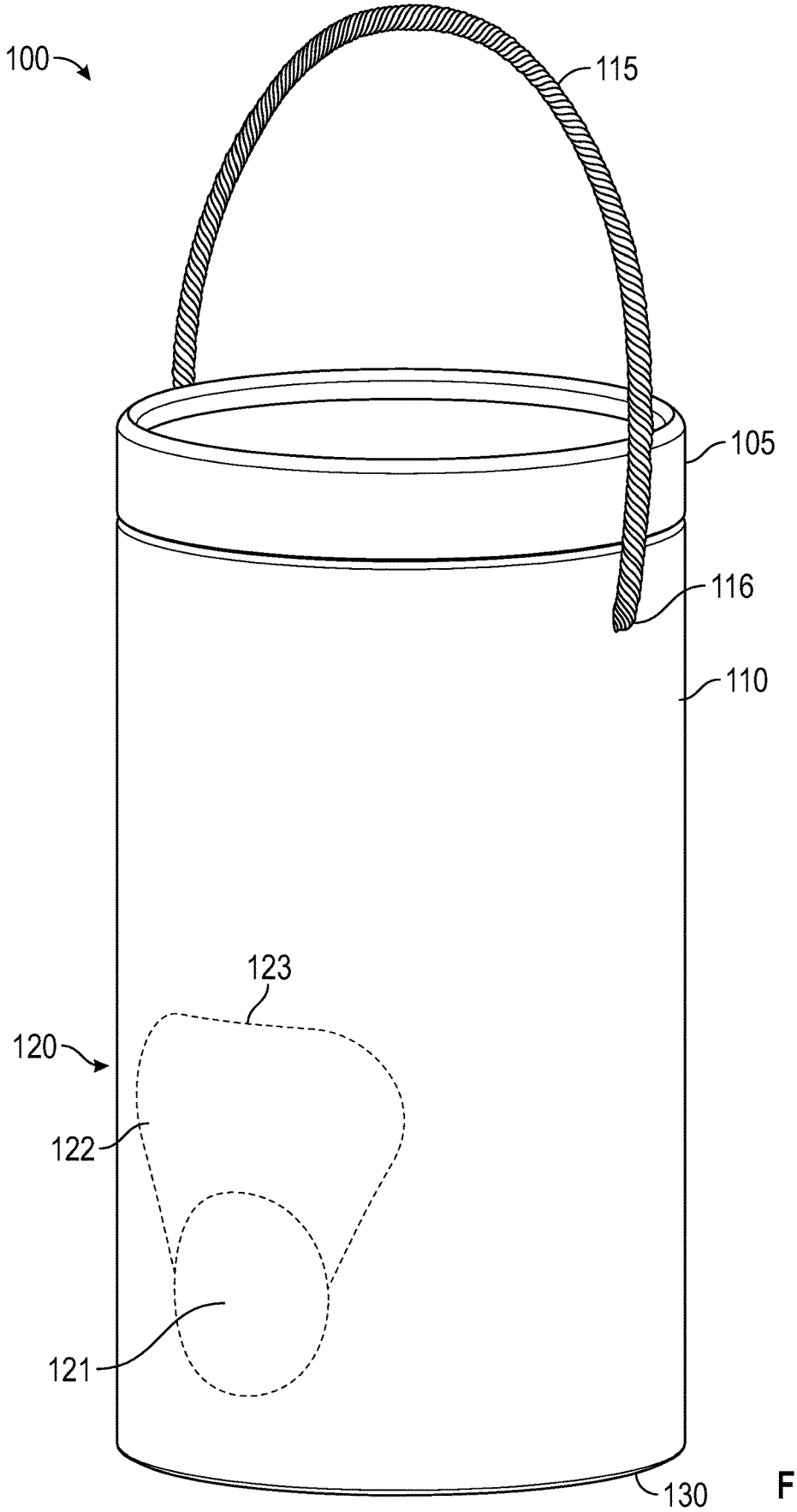
FIG. 1 is an image of a wine storage container according to an embodiment of the present disclosure.

Reference will now be made in more detail to embodiments, examples of which are illustrated in the accompanying drawings, wherein like reference numerals refer to like elements throughout, and duplicative descriptions thereof may not be provided, and duplicative descriptions thereof may not be provided. In this regard, the present embodiments may have different forms and should not be construed as being limited to the descriptions set forth herein. Accordingly, the embodiments are merely described, by referring to the drawings, to explain aspects of the present description. As utilized herein, the term "and/or" includes any and all combinations of one or more of the associated listed items. Expressions such as "at least one of," when preceding a list of elements, modify the entire list of elements and do not modify the individual elements of the list.

Because the present disclosure to be described may be variously modified and may have one or more suitable embodiments, specific embodiments are illustrated in the drawings and described in more detail in the detailed description. However, this is not intended to limit the present disclosure to a specific embodiment, and it should be understood to include all modifications, equivalents, or substitutes included in the technical scope of the present disclosure.

The terms utilized are only utilized to describe specific embodiments and are not intended to limit the present disclosure. Singular expressions include plural expressions unless the context clearly indicates otherwise. Hereinafter, it will be further understood that the terms "comprise", "include" or "have," when utilized in this specification, specify the presence of stated features, integers, steps, operations, elements, and/or components, but do not preclude the presence or addition of one or more other features, integers, steps, operations, elements, components, and/or groups thereof. The "/" utilized herein may be interpreted as "and" or as "or" depending on the situation.

In the drawings, thickness is enlarged or reduced in order to clearly express one or more suitable layers and regions. Throughout the specification, the same reference numerals designate the same components. Throughout the specification, when a component such as a layer, a film, a region, or a plate is mentioned to be placed "on" another component, it will be understood that it may be directly on another component or that another component may be interposed therebetween. Throughout the specification, although the terms "first", "second", "third", etc., may be utilized herein to describe one or more suitable elements, components, regions, and/or layers, these elements, components, regions, and/or layers should not be limited by these terms. These terms are only utilized to distinguish one component from another component.

One or more embodiments of the present disclosure are directed toward a wine storage container. In some embodiments, the wine storage container may be a hollow tube (e.g., a hollow cylinder) configured to hold an inner wine container. It will be appreciated that a size of the wine container may vary depending on the volume of wine desired to be stored in the container.

The wine storage container may include a mono-material construction lower portion, a removable lid (e.g., a removable paper or cardboard lid), a perforated region, and a reinforced double-disk base. The perforated region may be configured to be at least partially detached and/or removed to form a perforated opening in a surface of the wine container. The inner wine container may include a disposable plastic bag or pouch containing wine and include a spout for dispensing the wine (e.g., a wine tap). The inner wine container can be inserted and removed from the wine container such that another inner wine container can be inserted. When the inner wine container is inserted into the wine container (e.g., when the inner wine container is stored within the lower portion of the wine container), the wine tap may protrude from a surface of the wine container through the perforated opening of the wine container. The wine container is configured to be reused with different inner wine containers that may be replaced after all of the wine has been dispensed. The wine container embodiments disclosed herein may be reusable and may limit wine container packaging waste.

FIG. 1 shows an image of a wine storage container according to an embodiment of the present disclosure.

Referring to FIG. 1, a wine storage container 100 may include a lid 105, a lower portion 110, a handle 115, a perforated opening 120, and a base 130. The lower portion 110 of the wine storage container 100 may be a hollow tube (e.g., a cylindrical tube) configured to hold an inner wine container. The inner wine container (See FIG. 2B) may include a plastic bag, pouch, or other container with a spout for dispensing the wine (e.g., a wine tap). The wine container 100 may be composed of a single material (e.g., mono-material construction). For example, the wine container 100 may be composed of 100% paperboard. Further, the base 130 of the wine container 100 may be reinforced by two paper disks bound together with an adhesive (e.g., double-disk base). In some embodiments, the double-disk base may include two disk-shaped components that are attached together (e.g., glued together using an adhesive). The double-disk base 130 is coupled to the lower portion of the wine container 100 by an adhesive and thereby reinforces the wine container 100 against a weight of the inner wine container during transit of the wine container 100. In some embodiments, the wine container 100 may be dimensioned to be shorter and/or thinner (i.e., have a smaller maximum radius) than a traditional bottle of wine so that the wine container can be accommodated into wine fridges or other wine storage mechanisms. In one embodiment, the wine container 100 may have a diameter of about 5 inches and a height of about 9 inches. However, as will be appreciated, a size of the wine container may vary depending on the volume of wine desired to be stored in the container.

The lid 105 may be configured to be removable from the lower portion 110 by applying a force to the lid 105 in a direction opposite from the lower portion 110. When the lid 105 is removed, an opening of wine container 100 is exposed at an end of the lower portion 110 where the lid 105 was attached. The inner wine container can be inserted or removed through the opening. The lid 105 can be reattached to the lower portion 110 by inserting the lid 105 over the opening of the lower portion 110. In some embodiments, the height of the lid 105 may be about 1 inch. In some embodiments, the lid 105 may be entirely composed of paperboard.

The handle 115 may be used to facilitate the portability of the wine container 100 allowing the wine to be easily carried and allowing the wine container to be hung from the handle when serving wine from the container if desired. The handle 115 may be coupled to the wine container 100 and extend from openings 116 (e.g., round openings) near the end of the lower portion 110 where the lid 105 was attached. In some embodiments, the handle 115 may be coupled to the wine container 100 using small stoppers attached to ends of the handle 115. For example, the stopper may be positioned on the inside of the wine container 100 where it can abut to an inner surface of the lower portion 110 and thereby can prevent the ends of the handle 115 from being pulled out from the wine container 100. It will be appreciated that the handle 115 may also be attached by an adhesive and/or another coupling mechanism such that it does not detach from the lower portion 110. In some embodiments, the openings 116 may be positioned in an upper region of the lower portion proximate to the opening so that the wine container 100 remains upright when carried or hung by the handle 115. In one embodiment, the openings 116 may be about 2 inches from the end of the lower portion 110 where the lid 105 was attached. In one embodiment, the handle may include a rope or a string that is lightweight and flexible to allow the wine container 100 to be carried, but also such that the handle 115 does not take up much space when the wine container 100 is stored. For example, when the wine container 100 is stored upright, the handle 115 handle can lie flat across the top of the wine container 100 or against the side of the wine container 100 such that it does not add significant height to the wine container 100. Additionally, when the wine container 100 is stored on its side, the handle 115 can lie against a side of the wine container 100 so that it does not significantly increase a width of the wine container 100. In one embodiment, the handle 115 may be about 14.75 inches long and may be 0.25 inches in diameter, but it will be appreciated that the handle 115 length and thickness may vary. In another embodiment, the handle 115 may be relatively rigid and can be made from wood, metal, or plastic.

Figure 3:
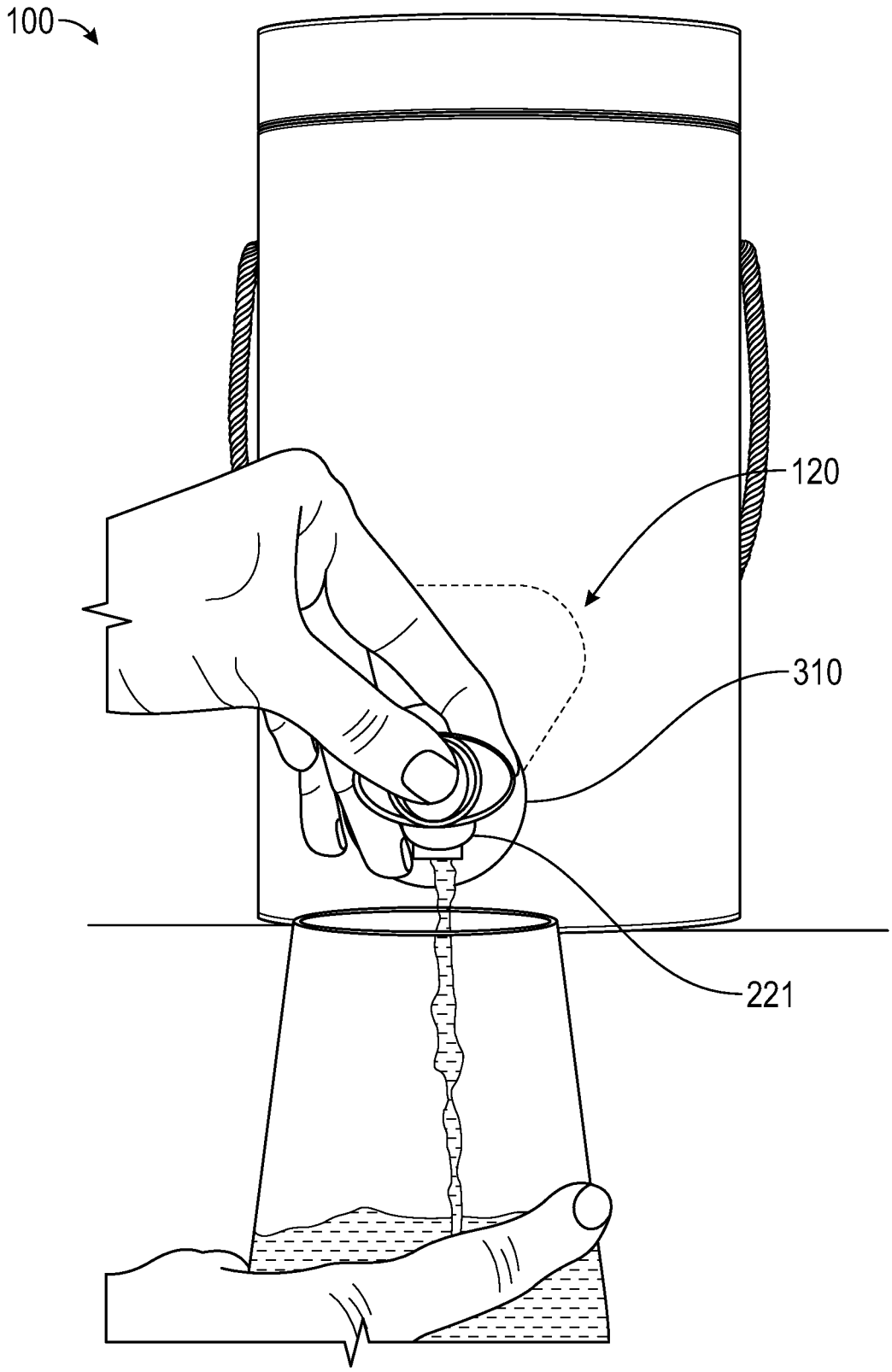
FIG. 3 shows an image of the wine container with the inner wine container inserted inside the lower portion with the lid on according to an embodiment of the present disclosure.

The perforated region 120 may be positioned near the base 130 of the wine container 100 and allows the lower portion 110 to have a continuous surface such that there are not openings or crevices that may catch or be hooked during transport and thereby damaging the lower portion. The continuous surface of the lower portion 110 also protects the inner wine container and can prevent the inner wine container from being punctured or otherwise damaged during transport. In some embodiments, the perforated region 120 may be positioned in a range from about 0.5 inches to about 4 inches from the base 130. Further, the perforated region 120 may include perforated lines that define a circle region 121 and an inverse trapezoid region 122 where the circle region 121 may be connected to a base of the trapezoid region 122 and be configured to accommodate a wine tap 221 (FIG. 3). In one embodiment, the diameter of the circle region 121 may be about 1.5 inches and the height of the inverse trapezoid region 122 may be about 2 inches. In some embodiments, an edge 123 of the inverse trapezoid region 122 may not be perforated and may have an indented portion that can allow edge 123 to be folded such that it mimics the functioning of a hinge. The perforated region 120 may be configured to be detached from the remainder of the lower portion 110 along the perforated lines to form an opening (e.g., a perforated opening) along the perforated lines of the perforated region 120. In some embodiments, the circle region 121 may be removed entirely, and the remaining inverse trapezoid region 122 may be pulled up to create a "flap" that can pivot along the edge 123 over the perforated opening and can thereby engage with a tab on the wine container. A spout (e.g., a tap) of the inner wine container can protrude from a surface of the wine container 100 through the perforated opening and be engaged by the flap portion such that the tap is stabilized in a particular position. When in use, the tap of the inner wine container can be used to release wine stored in the inner wine container through the flap.

Figure 2A:
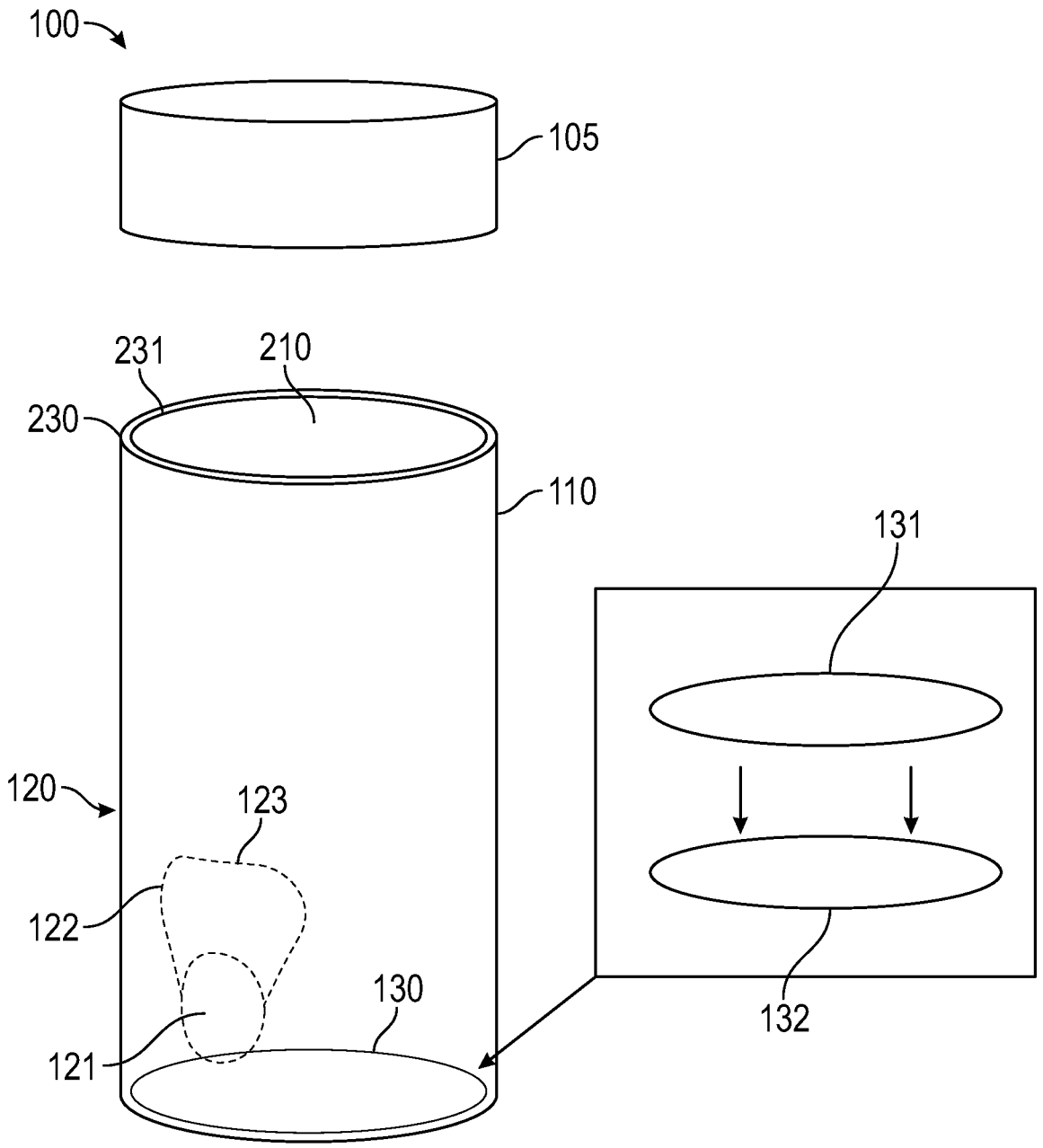
FIG. 2A shows an image of the wine container with the lid separated from the lower portion according to an embodiment of the present disclosure.
Figure 2B:
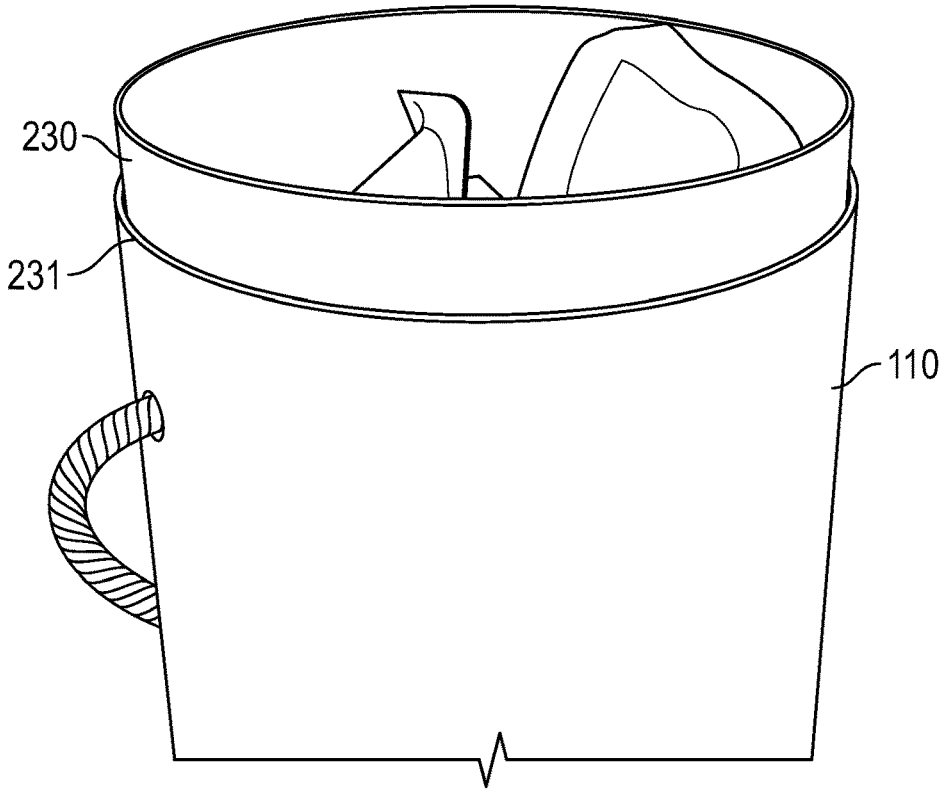
FIG. 2B shows an enlarged image of the top of an inner wine container inside the lower portion without the lid according to an embodiment of the present disclosure.
Figure 2C:
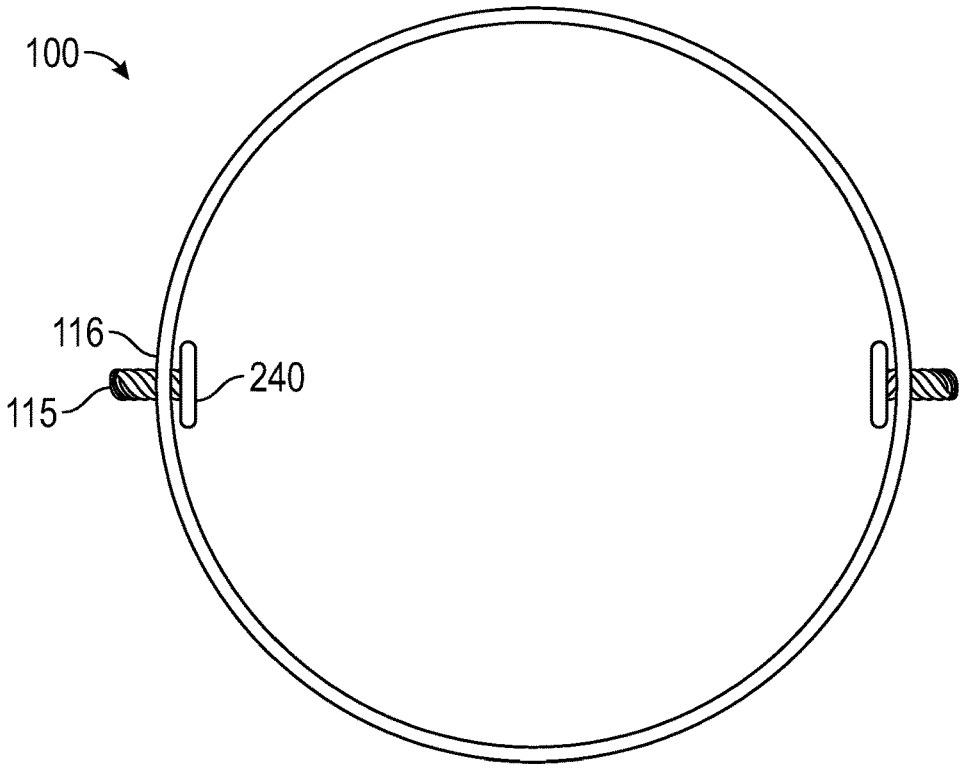
FIG. 2C shows an aerial view of the top of the wine container without the lid according to an embodiment of the present disclosure.
Figure 2D:
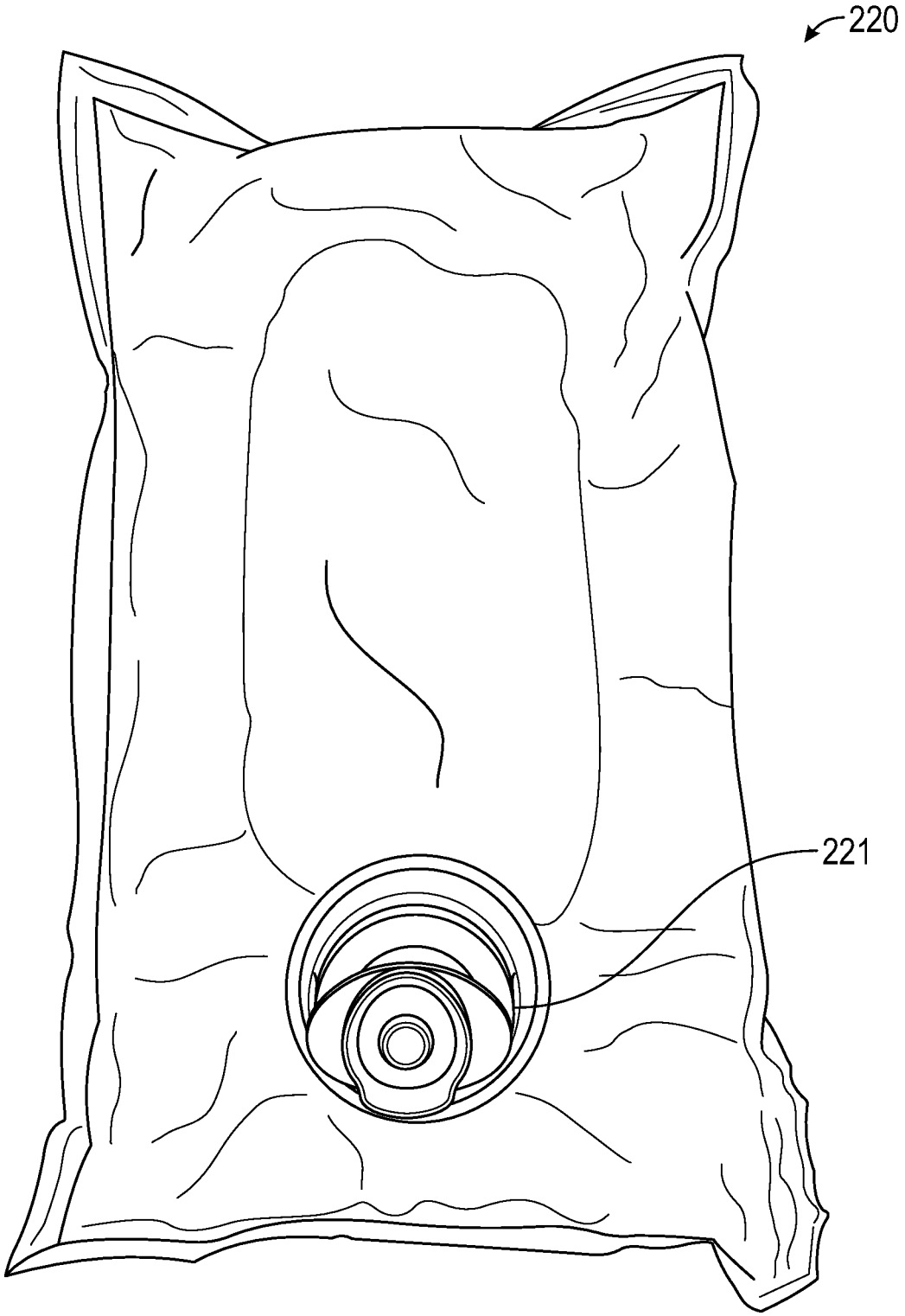
FIG. 2D shows an image of the inner wine container according to an embodiment of the present disclosure.

FIG. 2A shows an image of the wine container with the lid separated from the lower portion according to an embodiment of the present disclosure. FIG. 2B shows an enlarged image of the top of the inner wine container without the lid according to an embodiment of the present disclosure. FIG. 2C shows an aerial view of the top of the wine container without the lid according to an embodiment of the present disclosure. FIG. 2D shows an image of an inner wine container according to an embodiment of the present disclosure.

Referring to FIG. 2A, the lid 105 may be configured to be removable from the lower portion 110 by applying a force to the lid 105 in a direction opposite from the lower portion 110. When the lid 105 is removed, an opening 210 of wine container 100 is exposed at an end of the lower portion 110 where the lid 105 was attached. Further, the base 130 of the wine container 100 may be reinforced by two paper disks bound together with an adhesive (e.g., double-disk base). In some embodiments, the double-disk base may include two disk-shaped components 131 and 132 that are attached together (e.g., glued together using an adhesive). The double-disk base 130 is coupled to the lower portion of the wine container 100 by an adhesive and thereby reinforces the wine container 100 against a weight of the inner wine container during transit of the wine container 100. As shown in FIG. 2B, an upper region 230 of the lower portion 110 of the wine container has a slightly smaller outer diameter than a remainder of the lower portion 110 to accommodate the lid 105 such that when the lid is on the lower portion 110, an outer edge of the lid is substantially flush with an outer edge of the lower portion 110. Accordingly, the lid 105 can be securely maintained on the lower portion 110 an outer surface of the lower portion 110 may be substantially smooth allowing the wine container to be efficiently stored next to other wine containers (or other items) without taking up extra space or having an irregular shape. In some embodiments, the length of the upper region 230 may be about 1 inch. Further, the upper region 230 forms a step 231 on which a lower surface of the lid 105 can rest when the lid is on the lower portion 110. Because the edge of the lid 105 can be flush with the edge of the lower portion 110 rather than form a protruding edge, the likelihood of the lid 105 being accidentally pushed off during transport or handling is reduced.

Referring to FIG. 2C, the inside of the wine container 100 may be a hollow cylinder. Additionally, the handle 115 may be coupled to the wine container 100 and extend from openings 116 (e.g., round openings) near the end of the lower portion 110 where the lid 105 was attached. In some embodiments, the handle 115 may be coupled to the wine container 100 using small stoppers 240 attached to ends of the handle 115. For example, the stopper 240 may be positioned on the inside of the wine container 100 where it can abut to an inner surface of the lower portion 110 and thereby can prevent the ends of the handle 115 from being pulled out from the wine container 100. It will be appreciated that the handle 115 may also be attached by an adhesive and/or another coupling mechanism such that it does not detach from the lower portion 110. In some embodiments, the openings 116 may be positioned in an upper region of the lower portion 110 proximate to the opening so that the wine container 100 remains upright when carried or hung by the handle 115.

Referring to FIG. 2D, an inner wine container 220 may include a plastic bag or pouch that contains the wine and may include a wine tap 221 for dispensing the wine. The inner wine container 220 may be inserted and removed from the wine container 100 through the opening 210. When the inner wine container is inserted into the wine container 100 through the opening 210, the wine tap 221 can be inserted through the perforated opening formed in the perforated region 120 such that the wine tap protrudes from a surface of the wine container 100 through the perforated opening. As disclosed herein, the perforated region 120 may include a circle region 121 connected to a base of an inverse trapezoid region 122. In some embodiments, the circle region 121 may be removed, and the inverse trapezoid region 122 may be pulled up to create a "flap" that can pivot along the edge 123 over the perforated opening. Accordingly, the flap may be used to engage the wine tap 221 and to thereby stabilize the wine tap.

FIG. 3 shows an image of the wine container with the inner wine container inserted inside the wine container according to an embodiment of the present disclosure.

Referring to FIG. 3, when the inner wine container is inserted into the wine container 100, the wine tap 221 of the inner wine container may protrude from the wine container 100 through a perforated opening 310 formed in the perforated region 120. The wine tap 221 can dispense wine while the inner wine container is inside the wine container 100. When the inner wine container is empty, it can be removed from the wine container 100 and a new inner wine container can be inserted into the wine container 100. This allows the wine container 100 to be reusable, which reduces the amount of environmental waste from the wine container 100.

Figure 4:
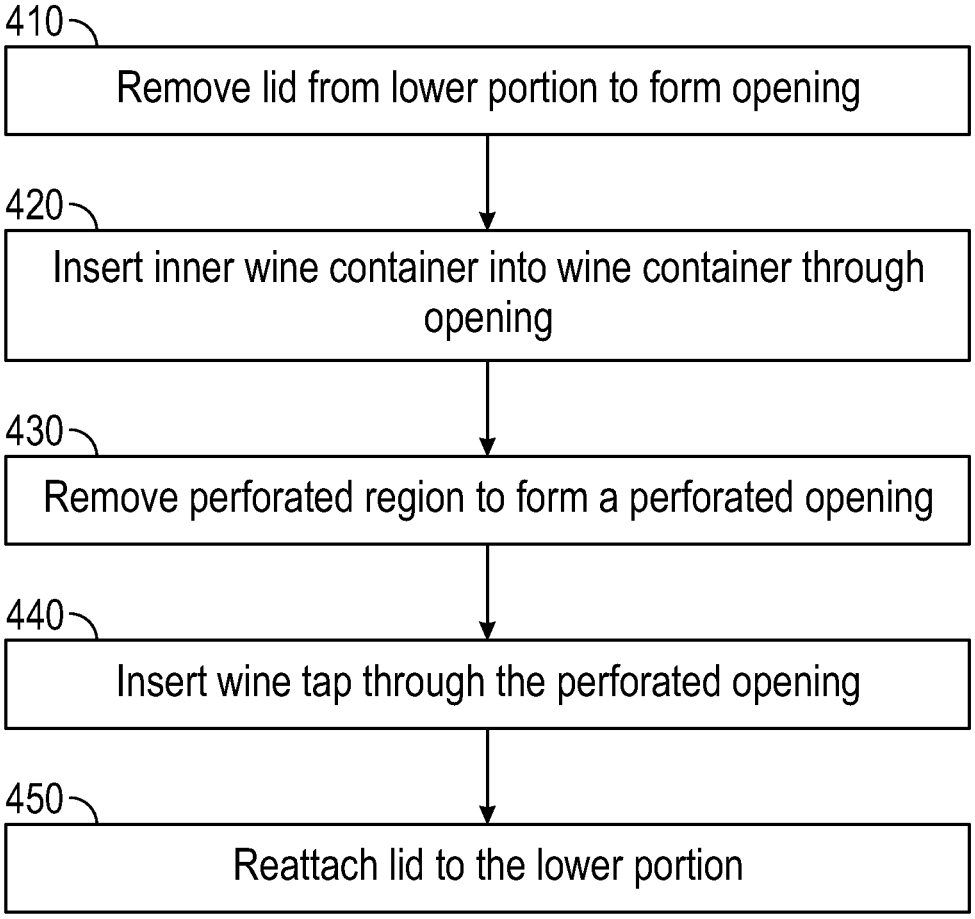
FIG. 4 is a flowchart for inserting an inner wine container into the wine container according to an embodiment of the present disclosure

FIG. 4 is a flowchart for inserting an inner wine container into the wine container according to an embodiment of the present disclosure. According to some example embodiments, the number and order of operations illustrated in FIG. 4 may vary. For example, according to some example embodiments, there may be fewer or additional operations, unless otherwise stated or implied to the contrary. Additionally, the order of the operations may vary, unless otherwise stated or implied to the contrary.

Referring to FIG. 4, the process of inserting an inner wine container into a wine container may begin in 410 by removing the lid of the wine container to form an opening at an end of the wine container where the lid had been attached. In 420, the inner wine container may be inserted into the wine container through the opening. In 430, the perforated region may be removed to form a perforated opening. In some embodiments, the perforated opening may be defined by the perforated lines of the perforated region. In 440, a wine tap of the inner wine container may be inserted through the perforated opening such that the wine tap protrudes from a surface of the wine container. In 450, the lid can be reattached to the end of the wine container over the opening. It will be appreciated that once the inner wine container no longer holds any wine or is otherwise no longer necessary, the lid 105 can be removed again, the inner wine container can be taken out of the lower portion 110, a new inner wine container can be inserted into the lower portion, and then the lid can be replaced. It will further be appreciated that this process can be repeated many times using a single wine container 100 for numerous inner wine containers 220.

As utilized herein, the term "substantially," "about," and similar terms are utilized as terms of approximation and not as terms of degree, and are intended to account for the inherent deviations in measured or calculated values that would be recognized by those of ordinary skill in the art. "About" or "approximately," as utilized herein, is inclusive of the stated value and refers to within an acceptable range of deviation for the particular value as determined by one of ordinary skill in the art, considering the measurement in question and the error associated with measurement of the particular quantity (i.e., the limitations of the measurement system). For example, "about" may refer to within one or more standard deviations, or within ±30%, 20%, 10%, 5% of the stated value.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

The utilize of "may" when describing embodiments of the present disclosure refers to "one or more embodiments of the present disclosure."

As utilized herein, the singular forms "a", "an" and "the" are intended to include the plural forms as well, unless the context clearly indicates otherwise.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the drawings, it will be understood by those of ordinary skill in the art that one or more suitable changes in form and details may be made therein without departing from the spirit and scope of the disclosure as defined by the following claims and equivalents thereof and equivalents thereof.

What is claimed is:

1. A wine container comprising:

a lid;

a lower portion comprising a first end and a second end opposite to the first end, wherein the first end comprises an opening and the second end comprises a base;

a handle; and a perforated region, wherein the lid is configured to be attached to the lower portion at the first end of the lower portion, wherein the handle is attached to the lower portion, wherein the perforated region is located on a bottom third of the lower portion, wherein the perforated region is configured to be removable to form a perforated opening, and wherein the base comprises two paper disks bound together with an adhesive.

2. The wine container of claim 1, wherein the lower portion is a cylindrical tube.

3. The wine container of claim 1, wherein the perforated region comprises a perforated circle and a perforated trapezoid, wherein the perforated circle is positioned adjacent to a base of the perforated trapezoid.

4. The wine container of claim 3, wherein the perforated circle has a diameter of about 1.5 inches and the perforated trapezoid has a height of about 2 inches.

5. The wine container of claim 1, wherein the handle is attached to the lower portion proximate to the first end of the lower portion.

6. The wine container of claim 1, wherein the wine container further comprises an inner wine container inside the wine container.

7. The wine container of claim 6, wherein the inner wine container comprises wine and a wine tap for dispensing the wine inside the inner wine container.

8. The wine container of claim 1, wherein the wine container comprises kraft paperboard.

9. A method for inserting an inner wine container into a wine container, wherein the inner wine container comprises wine and a wine tap for dispensing the wine, and wherein the wine container comprises a lid at a first end of the wine container, a lower portion, and a perforated region on the lower portion, the method comprising, removing the lid from the first end of the lower portion to expose an opening at the first end of the lower portion;

removing the perforated region to form a perforated opening;

inserting the inner wine container into the opening of the lower portion;

inserting the wine tap of the inner wine container through the perforated opening such that the wine tap protrudes from a surface of the wine container; and reattaching the lid to the first end of the lower portion, wherein the lower portion further comprise a base at a second end opposite to the first end of the lower portion, and wherein the base comprises two paper disks bound together with an adhesive.

10. The method of claim 9, wherein the lower portion is a cylindrical tube.

11. The method of claim 9, wherein the perforated region comprises a perforated circle and a perforated trapezoid, wherein the perforated circle is positioned adjacent to a base of the perforated trapezoid.

12. The method of claim 11, wherein the perforated circle has a diameter of about 1.5 inches and the perforated trapezoid has a height of about 2 inches.

13. The method of claim 9, wherein the wine container comprises kraft paperboard.

14. A wine container comprising:

a hollow tube comprising a first end and a base; and a perforated region positioned on a lower portion of the base of the hollow tube, wherein the perforated region comprises a perforated circle and a perforated trapezoid, wherein the perforated circle is positioned adjacent to a base of the perforated trapezoid, wherein the perforated region is configured to be removable to form a perforated opening, and wherein the base comprises two paper disks bound together with an adhesive.

15. The wine container of claim 14, wherein the perforated circle has a diameter of about 1.5 inches and the perforated trapezoid has a height of about 2 inches.

16. The wine container of claim 14, wherein the wine container comprises kraft paperboard.

* * * * *